United States Patent [19]

Morris

[11] Patent Number: 4,915,803

[45] Date of Patent: Apr. 10, 1990

[54] COMBINATION SEAL AND FRAME COVER MEMBER FOR A FILTER PRESS TYPE ELECTROLYTIC CELL

[75] Inventor: Gregory J. E. Morris, Milan, Italy

[73] Assignee: The Dow Chemical Company, Midland, Mich.

[21] Appl. No.: 249,640

[22] Filed: Sep. 26, 1988

[51] Int. Cl.[4] ..... C25B 1/24; C25B 9/00; C25B 13/00

[52] U.S. Cl. ..... 204/128; 204/256; 204/258; 204/266; 204/279; 204/253; 204/252; 204/263; 204/257

[58] Field of Search ..... 204/279, 252–258, 204/263, 266, 128

[56] References Cited

U.S. PATENT DOCUMENTS

| | | | |
|---|---|---|---|
| 1,721,407 | 7/1929 | Pechkranz | 204/254 |
| 2,306,160 | 12/1942 | Freyssinet | 277/34.3 |
| 3,378,480 | 4/1968 | Reishagen et al. | 204/253 |
| 3,857,773 | 12/1974 | DuBois et al. | 204/256 X |
| 3,869,375 | 3/1975 | Ono et al. | 204/279 X |
| 3,964,932 | 6/1976 | Oltman et al. | 429/185 |
| 4,013,535 | 3/1977 | White | 204/252 |
| 4,026,782 | 5/1977 | Bouy et al. | 204/254 |
| 4,076,609 | 2/1978 | Mas | 204/258 |
| 4,098,670 | 7/1978 | Custer et al. | 204/252 |
| 4,107,023 | 8/1978 | Mentz | 204/269 |
| 4,111,779 | 9/1978 | Seko et al. | 204/255 |
| 4,137,144 | 1/1979 | Kenney | 204/268 |
| 4,139,448 | 2/1979 | Wallace | 204/256 |
| 4,175,024 | 11/1979 | Darlington | 204/252 |
| 4,175,025 | 11/1979 | Creamer et al. | 204/253 |
| 4,188,464 | 2/1980 | Adams et al. | 429/210 |
| 4,191,627 | 3/1980 | Specht | 204/296 |
| 4,197,206 | 4/1980 | Karn | 204/253 X |
| 4,207,165 | 6/1980 | Mose et al. | 204/258 |
| 4,217,200 | 8/1980 | Kedem et al. | 204/301 |
| 4,219,394 | 8/1980 | Babinsky et al. | 204/98 |
| 4,253,932 | 3/1981 | Mose et al. | 204/253 |
| 4,268,372 | 5/1981 | Lizima et al. | 204/252 |
| 4,268,373 | 5/1981 | Lizima et al. | 204/252 |
| 4,274,928 | 6/1981 | Cunningham | 204/98 |
| 4,279,731 | 7/1981 | Pellegi | 204/254 |
| 4,313,812 | 2/1982 | Kircher | 204/253 |
| 4,332,661 | 6/1982 | Ford et al. | 204/253 |
| 4,342,460 | 8/1982 | Eng | 204/279 X |
| 4,344,633 | 8/1982 | Niksa | 204/279 X |
| 4,381,984 | 5/1983 | Kircher | 204/258 |
| 4,390,408 | 6/1983 | Kircher | 204/284 |
| 4,409,084 | 10/1983 | Yamaguchi et al. | 204/257 |
| 4,431,502 | 2/1984 | Ford | 204/252 |
| 4,441,977 | 4/1984 | Ford | 204/252 |
| 4,470,608 | 9/1984 | Warren | 277/164 |
| 4,488,946 | 12/1984 | Morris et al. | 204/98 |

(List continued on next page.)

FOREIGN PATENT DOCUMENTS

| | | |
|---|---|---|
| 0051380 | 5/1982 | European Pat. Off. . |
| 0080288 | 11/1982 | European Pat. Off. . |
| 0118973 | 1/1984 | European Pat. Off. . |
| 2821983 | 11/1979 | Fed. Rep. of Germany . |
| 53-63284 | 6/1978 | Japan . |
| 53-146272 | 12/1978 | Japan . |
| 56-38484 | 4/1981 | Japan . |
| 58-4926 | 1/1983 | Japan . |
| 58-35272 | 8/1983 | Japan . |
| 1082867 | 3/1984 | U.S.S.R. . |
| 1078129 | 12/1964 | United Kingdom . |
| 1192245 | 5/1970 | United Kingdom . |
| 2013242 | 8/1979 | United Kingdom . |

*Primary Examiner*—Donald R. Valentine
*Attorney, Agent, or Firm*—W. J. Lee

[57] ABSTRACT

A combination electrolysis cell seal member and electrolysis cell frame cover member suitable for use as a gasket/cover member in an electrolytic cell of the filter press type. The gasket/cover member used for a filter press-type electrolytic cell includes two gasket/cover load-bearing sections integral with a peripheral frame cover section. The gasket load-bearing sections contains a first and second side. The first side contacts a electrolysis cell membrane member and the second side contacts an electrolysis cell frame member. The membrane is interposed between two electrolysis cell frame members each having a gasket/cover member secured thereto.

7 Claims, 2 Drawing Sheets

U.S. PATENT DOCUMENTS

| | | | |
|---|---|---|---|
| 4,490,231 | 12/1984 | Boulton | 204/263 |
| 4,493,759 | 1/1985 | Boulton et al. | 204/252 |
| 4,585,527 | 4/1986 | Northway et al. | 205/55 |
| 4,604,331 | 8/1986 | Louis | 429/35 |
| 4,610,765 | 9/1986 | Beaver et al. | 204/128 |
| 4,623,599 | 11/1986 | Vourlis | 429/174 |
| 4,638,109 | 1/1987 | Ford | 204/253 |
| 4,648,953 | 3/1987 | Wardle et al. | 204/234 |
| 4,654,134 | 3/1987 | Morris et al. | 204/252 |
| 4,656,104 | 4/1987 | Tucholski | 429/185 |
| 4,721,555 | 1/1988 | Grosshandler | 204/252 |
| 4,738,905 | 4/1988 | Collins | 429/36 |
| 4,748,092 | 5/1988 | Hekal | 429/35 |

COMBINATION SEAL AND FRAME COVER MEMBER FOR A FILTER PRESS TYPE ELECTROLYTIC CELL

BACKGROUND OF THE INVENTION

This invention relates to a method and device for sealing a filter press-type electrolytic cell, and more particularly, to a combination seal and cover member for an electrolysis cell frame member for example used in a filter press type electrolytic cells.

Electrolytic cells of the filter press-type are known to be used for the electrolysis of aqueous salt solutions and have been commercially employed for the production of chlorine and caustic from brine. The filter press type electrolytic cell for electrolysis of an aqueous salt solution commonly employ a plurality of frame members with electrodes held thereto and assembled in a filter press type arrangement, separated from each other by membranes, diaphragms or microporous separators, forming a plurality of anolyte and catholyte compartments. The electrodes used in the cells are generally either monopolar or bipolar electrodes.

Membranes typically used in the cells are generally available in sheet form and have ion exchange properties, for example, membrane materials employed in the cells are such as those marketed by E. I. duPont de Nemours and Company under the trademark Nafion ® and by Asahi Glass Company Ltd. under the trademark Flemion ®.

Typically, a press means is used to compress or clamp together the separators in sheet form between the sides of the frame members of the filter press cell and electrolyte is used to fill the compartments of the cell. To provide a fluid-tight seal between the frame members and the separator without damaging the separator, the electrolytic cells employ substantially flat, solid gaskets having a rectangular cross-sectional area or tubular type gaskets having a circular cross-sectional area made of elastomeric material. One or two gaskets can be used to fit between the cell frame members on a peripheral flange portion of the frame members and on either side of the membrane. While most gaskets can provide a liquid-tight seal the seal is generally not completely fluid-tight, i.e. liquid and gas-tight. To some extent fluid seepage occurs at the interface formed between the membrane contacting the gasket members.

The problem of fluid seepage occurs particularly in cells which employ membrane separators that utilize a support or reinforcement material in the membrane. This reinforcement material is usually used because it provides the normally weak membrane sufficient strength for handling and installing into industrial size membrane filter press electrolytic cells. The problem associated with the use of support or reinforcements in membranes is it allows gases and liquids to seep from the inside of the operating cell to the exterior. This seepage can cause severe damage to the outer surface of the cell peripheral surface. Fluid seepage can also exposes operating personnel to potentially hazardous chemicals. The problem of fluid seepage is aggravated by the use of pressurized cells operating under an internal electrode compartment pressure. The contemporary compression-seal means now being used by industry cannot significantly block the leakage of the liquids and gases in the electrolytic cells.

Another problem associated with the use of conventional gasketing of filter press cells is membrane drying.

In a conventional membrane filter press type cell operation, the membrane is usually extended past the periphery of the cell and exposed to the environment. This exposure, in time, allows the membrane to dry and possibly crack. Any cracks formed in the exposed surface of the membrane can propagate, during operation of the cell, through the membrane to the portion of the membrane which is inside the cell, i.e., the operating area of the membrane, which in turn, can cause severe operation problems such as explosions and eventual shutdown of the cell operation.

Still another problem associated with the assembly of filter press cells is attaching the gaskets to the frame member. Heretofore, the cell gaskets were glued or taped to one of the electrode frames prior to assembling to cell elements together. In another method, the cell frames, membranes and gaskets were assembled in the horizontal position to ensure a planar placement of the membrane and gaskets, and thereafter the assembled cell was stood in the upright position for operation. These approaches are unsatisfactory as they present time consuming complex procedures, costly equipment and safety hazards to personnel. These procedures may also allow the membrane to dry and crack thereby rendering it unfit for operation.

It is desired to provide a means suitable for sealing an electrolytic cell to reduce the complexity of assembling the elements of an electrolytic cell.

SUMMARY OF THE INVENTION

The present invention is directed to a combination electrolysis cell seal member and electrolysis cell frame cover member for filter press type electrolytic cells. The seal/cover member contains two gasket load-bearing sections integral with a peripheral frame cover section. The gasket bearing load sections contains a first and second side. The first side contacts the membrane member and the second side contacts the frame member. The membrane is interposed between two adjacent seal/cover members' gasket load-bearing sections.

Another aspect of the invention is a method of sealing an electrolytic cell and covering the cell frame members using the combination seal and cover member above.

DETAILED DESCRIPTION OF THE PREFERRED EMBODIMENTS

Figure 1:
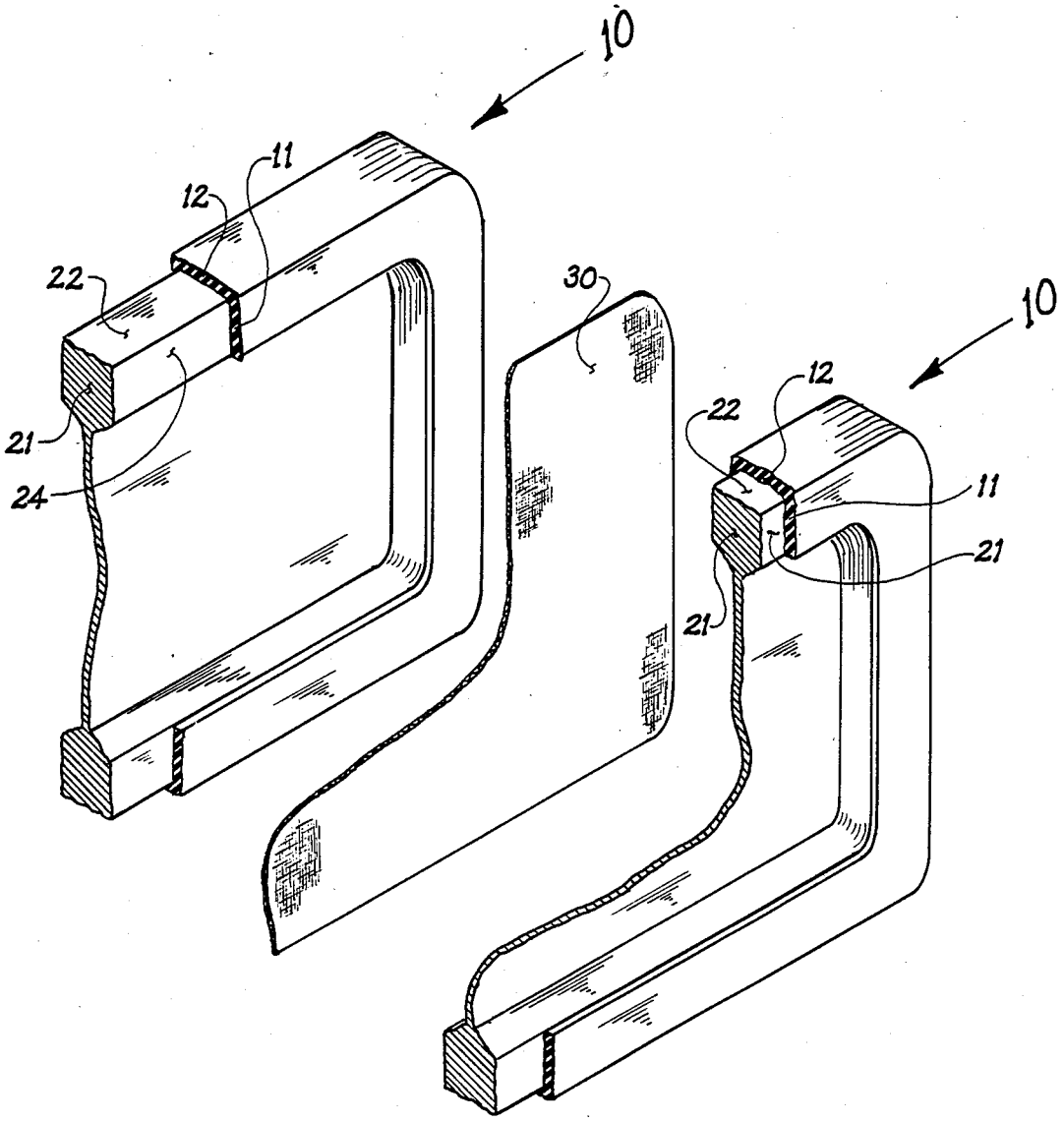
FIG. 1 is an exploded, partially broken-away perspective view showing a seal and cover member and a membrane between cell frames.
Figure 2:
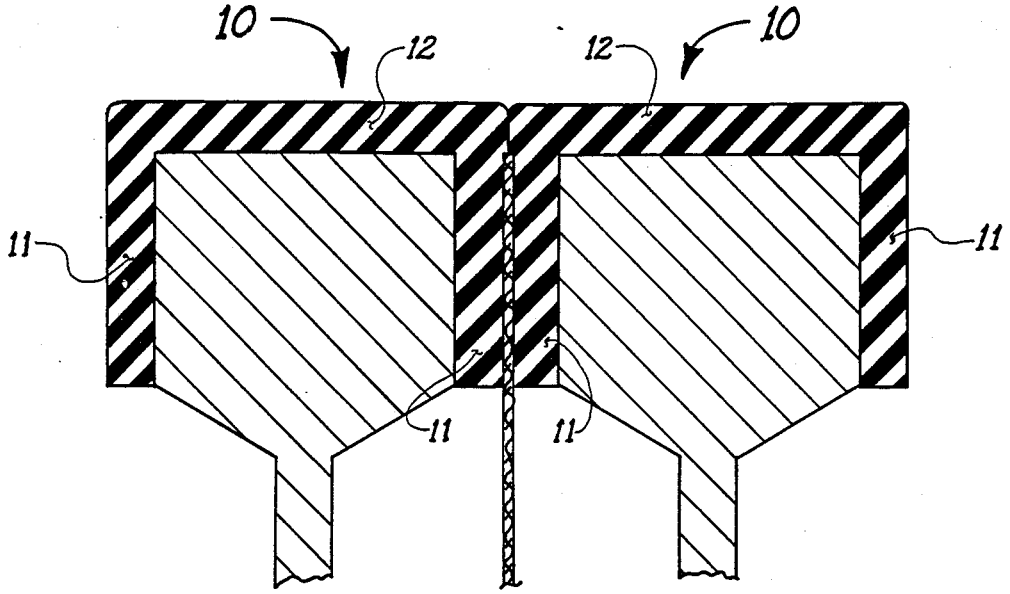
FIG. 2 is a cross-sectional side view showing a seal and cover member and a membrane between cell frames.
Figure 3:
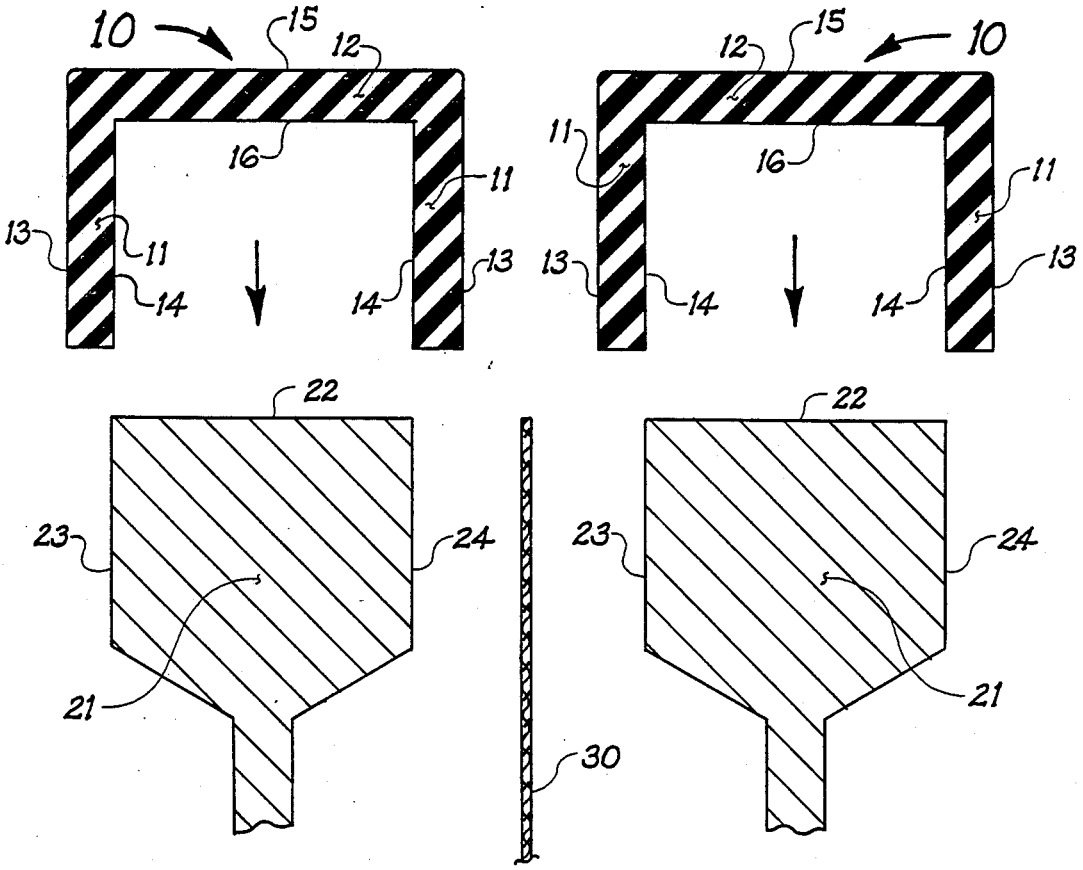
FIG. 3 is an exploded, cross-sectional view of FIG. 2.

With reference to FIGS. 1, 2 and 3, there is shown a combination electrolysis cell seal member and electrolysis cell frame cover member, generally indicated by numeral 10, for filter press-type electrolytic cells. The combination electrolysis cell seal member and electrolysis cell frame cover member 10 will be referred to herein as the gasket/cover member 10. However, it is understood that the gasket/cover member 10 is utilized for the dual purpose of providing a seal between electrolysis cell frame members and covering the cell frame members. The gasket/cover member 10 is shown in FIGS. 1, 2 and 3 disposed on cell frame members 21.

The gasket/cover member 10 comprises two gasket load-bearing sections 11 integral with a peripheral cell frame cover section 12.

Each of the gasket load-bearing sections 11 contains a first and second side, 13 and 14, respectively. The first side 13 contacts the membrane member 30 and the second side 14 contacts the flange portions 23 and 24 of the frame members 21. The cover section 12 contains a first and second side, 15 and 16, respectively. The first side 15 contacts the atmosphere and the second side 16 contacts the outer surface portion 22 of the frame member 21. The cover section 12 insulates the frame members 21 from the atmosphere.

The peripheral edge of a membrane 30 is interposed between two adjacent frame members 21 having a gasket/cover member 10 thereon such that the membrane is compressed between two adjacent gasket load-bearing sections 11.

While not shown in the Figures of the present invention, there are various embodiments which will become apparent to one skilled in the art after reading the description herein. For example, a groove and seal member, such as an O-ring member, can be interposed between the frame member 21 and a gasket load-bearing section 11 of the gasket/cover member 10, the groove and seal member being on the flange portion 23 or 24, or on the section 11 on the inside surface 14. In another embodiment, the groove and O-ring member can be placed on the outside surface 13 of the section 11. If a liner member is used to cover the frame, the frame members 21, and flange surfaces 23 and 24, the groove and O-ring member may be used between the frame member and liner or between the liner and a gasket load-bearing section. Also not shown in the Figures are means for attaching the membrane 30 to the gasket load-bearing section 11 of the gasket/cover member 10. Any suitable attachment means may be used, such as tape, glue, plastic clips or other such holding means.

The gasket/cover member 10 of the present invention is preferably a combination gasket member for providing a fluid-tight seal between the cell frame members and and a cover member for covering the periphery of cell frame members. The gasket/cover member 10 should be made of an electrically insulating material. It is desirable that the gasket/cover member 10 be flexible, and preferably resilient, in order to aid in achieving leak-tight seals in the electrolytic cell. The O-ring members can also be made of the same materials as described with reference to the gasket/cover member 10 herein. The O-ring members can also be an integral part of the gasket/cover member 10 if so desired.

The gasket/cover member 10 of the present invention should exhibit a high degree of resistance to corrosion by a variety of different electrolytes and products of electrolysis. However, the gasket/cover member 10 should show particular resistance to corrosion when the electrolyte which is electrolyzed is an aqueous solution of an alkali metal chloride, for example, an aqueous solution of sodium chloride. An aqueous solution of alkali metal chloride may be electrolyzed in a cell which comprises a separator between each anode and adjacent cathode. The gasket/cover member 10 should be resistant to wet chlorine produced during operation of such a cell.

The gasket/cover member 10 is suitably made of an organic polymeric material which material may be, for example, a polyolefin e.g. polyethylene or polypropylene: a hydrocarbon elastomer, e.g. an elastomer based on ethylene-propylene copolymer, an ethylene-propylene-diene copolymer, natural rubber or a styrene-butadiene rubber; or a chlorinated hydrocarbon, e.g. polyvinyl chloride or polyvinylidene chloride. It is particularly desirable that the material of the gasket/cover member 10 be chemically resistant to the liquors in the electrolytic cell, and when the cell is to be used in the electrolysis of aqueous alkali metal chloride solution the material may be fluorinated polymeric material, for example polytetrafluoroethylene, polyvinyl fluoride, polyvinylidene fluoride, fluorinated ethylene-propylene copolymer; tetrafluoroethylene-hexa-fluoropropyl copolymer, or a substrate having an outer layer of such a fluorinated polymeric material.

Suitable gasket/cover members 10 used in the present invention are those comprised of elastomeric solids. Examples of the elastomeric solids include chlorobutadiene rubber (neoprene), chlorosulfonated polyethylene (Hypalon ®), ethylene-propylene dimonomer (EPDM), or gum rubber.

The hardness of the gasket/cover member 10 is not critical and any suitable hardness may be selected for the gasket/cover member. Preferably, the gasket/cover member has a low degree of hardness which allows the gasket/cover member to fill in irregularities on the frame members and thus permit reduced tolerances which minimizes, for example, machining of metal electrolysis frame members and thus reduces production costs. For example, an elastomeric gasket/cover member having a hardness of about 50 durometer to about 90 durometer is suitable.

The thickness of the gasket/cover member 10 is also not critical, but suitable thickness should be selected for ease of manufacture of gasket/cover member used. For example, the thickness of the elastomeric gasket/cover member having a thickness of about 1.5 mm to about 5 mm is suitable.

The gasket/cover member 10 of the present invention may be used in any suitable filter press type cell, the structure and function of its central components being well known to one of skill in the art. The electrolytic cell may be of the filter press type comprising any number of alternating anodes and cathodes. Electrolytic cells of the aforementioned types are used on a large scale for the production of chlorine and caustic alkali.

Preferred filter press electrolytic cells for employing the present invention are bipolar or monopolar membrane cells in which the electrodes are oriented generally vertically. Suitable bipolar filter press membrane electrolytic cell in which the gasket/cover member may be used include, for example, those described in U.S. Pat. No. 4,488,946. Suitable filter press monopolar membrane electrolytic cells include those described in U.S. Pat. No. 4,056,458, issued Nov. 1, 1977, to G. R. Pohto et al.; U.S. Pat. No. 4,210,516, issued July 1, 1980, to L. Mose et al. and U.S. Pat. No. 4,217,199, issued Aug. 12, 1980, to H. Cunningham.

The electrolytic cell comprises an anode or a plurality of anodes and a cathode or a plurality of cathodes, and one or more gasket/cover members of the present invention compressed together with a separator between each anode and adjacent cathode which divides the cell into separate anode and cathode compartments.

The electrolytic cell is equipped with means for charging electrolyte to the cell and with means for removing the products of electrolysis from the cell. In particular, the anode compartments of the cell are provided with means for feeding aqueous alkali metal chloride electrolyte to the cell, suitably from a common header, and with means for removing products of electrolysis form the cell. Similarly, the cathode compartments of the cell are provided with means for removing products of electrolysis from the cell, and optionally with means for feeding water or other fluid to the cell. The electrolysis process may be operated by charging electrolyte to the electrolytic cell, electrolyzing the electrolyte therein, and removing the products of electrolysis from the electrolytic cell.

The separator used in the electrolytic cell may be a hydraulically permeable diaphragm or a substantially hydraulically impermeable ionically-permselective membrane.

In an electrolytic cell equipped with a hydraulically-permeable microporous diaphragm and where an aqueous alkali metal chloride solution is electrolyzed in such a cell the solution is charged to the anode compartments of the cell and chlorine produced during electrolysis is removed therefrom, the solution passes through the diaphragm to the cathode compartments of the cell and hydrogen and aqueous alkali metal hydroxide solution produced by electrolysis are removed therefrom.

In an electrolytic cell equipped with an essentially hydraulically impermeable cationically-permselective membrane, aqueous alkali metal chloride solution is charged to the anode compartments of the cell and chlorine produced during electrolysis and depleted alkali metal chloride solution are removed from the anode compartments, alkali metal ions are transported across the membranes to the cathode compartments of the cell to which water or dilute alkali metal hydroxide solution may be charged, and hydrogen and alkali metal hydroxide solution produced by the reaction of alkali metal ions with hydroxyl ions are removed from the cathode compartments of the cell.

Preferably, inert flexible separators having ion exchange properties and which are substantially impervious to the hydrodynamic flow of the electrolyte and the passage of gas products produced in the cell are employed. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. A composite membrane sold commercially by E.I. duPont de Nemours and Company under the trademark Nafion®is a suitable example of this membrane.

Another example of a suitable membrane is a cation exchange membrane using a carboxylic acid group as the ion exchange group. Carboxylic acid type cation exchange membranes are available commercially from the Asahi Glass Company under the trademark Flemion®.

The electrodes have frames 21 which have generally planar opposing surfaces such as flange surface 23 and 24 between which the gasket load bearing section 11 of gasket/cover members 10 are compressed. The frames are generally of a thick solid construction capable of withstanding the considerable compression force exerted upon the frames when the filter press cell is assembled. To prevent the gasket/cover member form "popping out" under compression, the frames should be substantially flat. To avoid the considerable expense of machining and finishing, the opposing planar surfaces of the frame members are free of recesses or grooves. However, recesses can be used in the cell frame members or in the gasket/cover member as aforementioned.

Electrode frame components may be in the shape of rectangular bars, C or U channels, cylindrical tubes, elliptical tubes as well as being I-shaped or H-shaped. Preferably, the frame components are in the shape of an I-shaped cross section as shown in FIG. 1.

The materials of construction for frame components may be any which are resistant to corrosion by the electrolytes and the products of electrolysis. For example, metal anode frames used in the electrolysis of alkali metal chlorides are constructed of valve metals such as titanium, tantalum, or tungsten and their alloys, with titanium being preferred. Cathode frames may be constructed of metals such as iron, steel, stainless steel, nickel, or alloys of these metals may be used as well as plastic materials such as polypropylene, polybutylene, polytetrafluoroethylene, FEP, and chlorendic acid based polyesters.

During assembly of the filter press electrolytic cell, pressing means such as tie bolts tightened around the parameter of the cell or hydraulic cylinders pressing against a mobile platen against the cell frame members is used. The pressing means bonds the individual electrodes, anodes, and cathodes alternately arranged, together. An adjacent electrode pair, a cathode and an anode, are compressed together so that the gasket/-cover member is compressed. The frame members are covered by the individual gasket/cover members which is inserted around the peripheral flange surface of the frames and a separator is interposed between frame members. As the electrode frames are compressed together by the application of a suitable closure force, the gasket load-bearing sections 11 gasket/cover member deform in a manner which effects a fluid-tight seal in the gasket load-bearing surface between adjacent electrode frames, as well as securing the separator along the outside surface of the gasket/cover member to avoid any undesired slippage.

What is claimed is:

1. A combination seal and cover member for a filter press type electrolytic cell comprising:

a pair of gasket load-bearing sections integral with a cover section for covering both the peripheral outer surface of a frame member and the load-bearing flange surfaces of the frame member, the gasket load-bearing sections including a first side for contacting a membrane member and a second side for contacting the flange portion of the frame member; the cover section with a first side for contacting the outer peripheral surface of a frame member and a second side for contacting the atmosphere.

2. A cell assembly comprising at least two adjacent frame members, at least two seal and cover members of claim 1 for covering said frame members and a separator interposed between the frame members.

3. A combination seal and cover member for a filter press type electrolytic cell comprising:

a pair of gasket load-bearing sections integral with a cover section for covering both the peripheral outer surface of a frame member and the load-bearing flange surfaces of the frame member, the gasket load-bearing sections including a first side for contacting a membrane member and a second side for contacting the flange portion of the frame member; the cover section with a first side for contacting the outer peripheral surface of a flange member and a second side for contacting the atmosphere; said seal and cover member including a recess portion in at least one flange portion of the frame member adapted for receiving a seal member.

4. A combination seal and cover member for a filter press type electrolytic cell comprising:

a pair of gasket load-bearing sections integral with a cover section for covering both the peripheral outer surface of a frame member and the load-bearing flange surfaces of the frame member, the gasket load-bearing sections including a first side for contacting a membrane and a second side for contacting the flange portion of the frame member; the cover section with a first side for contacting the outer peripheral surface of a frame member and a second side for contacting the atmosphere; said seal and cover member including a recess portion in at least one of the gasket load-bearing sections for receiving a seal member.

5. The seal/cover member of claim 3 or 4 wherein the seal member is an O-ring.

6. A method of sealing an electrolytic cell comprising:

(a) providing a combination seal and cover member comprising a pair of gasket load-bearing sections integral with a peripheral frame cover section for covering both the peripheral outer surface of a frame member and the load-bearing flange surfaces of the frame member, the gasket load-bearing sections including a first side for contacting a membrane member and a second side for contacting a frame member, the cover section with a first side for contacting the outer peripheral surface of a frame member and a second side for contacting the atmosphere;

(b) disposing said seal/cover member on at least two adjacent electrolytic cell frame members;

(c) interposing a sheet-like separator between at least the two adjacent electrolytic cell frame members with seal/cover members; the separator spacing apart an anode and a cathode compartments defined by the frame members and the separators; and (d) compressing the seal/cover member, separator and the adjacent frame members together.

7. A method of operating an electrolytic cell comprising:

(a) providing a combination seal and cover member comprising a pair of gasket load-bearing sections integral with a peripheral frame cover section for covering both the peripheral outer surface of a frame member and the load-bearing flange surfaces of the frame member, the gasket load-bearing sections including a first side for contacting a membrane member and a second side contacting a frame member, the cover section with a first side for contacting the outer peripheral surface of a frame member and a second side for contacting the atmosphere;

(b) disposing said seal/cover members on at least two adjacent electrolytic cell frame members;

(c) interposing a sheet-like separator between at least the two adjacent electrolytic cell frame members with seal/cover members; the separator spacing apart an anode and a cathode compartments defined by the adjacent frame members and the separator;

(d) compressing the seal/cover member, separator and the adjacent frame members together;

(e) feeding an aqueous alkali metal halide solution to the electrolytic cell; and (f) passing an electrical current from the anode to the cathode such that a halide is evolved at the anode.

* * * * *